US005144930A

United States Patent [19]

Tanabe

[11] Patent Number: 5,144,930

[45] Date of Patent: Sep. 8, 1992

[54] ELECTRONIC CONTROL TYPE FUEL INJECTION DEVICE

[75] Inventor: Tsuneo Tanabe, Himeji, Japan

[73] Assignee: Mitsubishi Denki K.K., Tokyo, Japan

[21] Appl. No.: 718,175

[22] Filed: Jun. 24, 1991

[30] Foreign Application Priority Data

Sep. 20, 1990 [JP] Japan ..... 2-252565

[51] Int. Cl.[5] ..... F02M 51/00

[52] U.S. Cl. ..... 123/478; 364/431.09; 364/431.1

[58] Field of Search ..... 123/478, 480, 491, 486, 123/339, 494; 364/431.07, 431.09, 431.1

[56] References Cited

U.S. PATENT DOCUMENTS

| | | | |
|---|---|---|---|
| 4,836,164 | 6/1989 | Morozumi et al. | 123/339 |
| 4,911,133 | 3/1990 | Sogawa | 123/494 |
| 4,957,089 | 9/1990 | Morikawa | 123/486 |
| 4,962,739 | 10/1990 | Wataya | 123/478 |
| 4,967,711 | 11/1990 | Morikawa | 123/478 |
| 5,016,595 | 5/1991 | Kawai et al. | 123/478 |

FOREIGN PATENT DOCUMENTS

| | | | |
|---|---|---|---|
| 25531 | 2/1983 | Japan | 123/478 |

OTHER PUBLICATIONS

Toyta: 4-V-EUE-VG System Troubleshooting Manual, 1978, pp. 1-16.

*Primary Examiner*—Raymond A. Nelli
*Attorney, Agent, or Firm*—Sughrue, Mion, Zinn Macpeak & Seas

[57] ABSTRACT

An electronic control type fuel injection device which comprises: means for determining a fuel quantity corresponding to a running condition of an internal combustion engine by a time length of a fuel injection pulse signal applied to an electromagnetic injection valve of an internal combustion engine; wherein a calculated value of Q/N of a basic fuel injection pulse width W, determined by an equation of $$W = K \times Q/N$$

where N is an engine revolution number, Q is an intake air quantity, and K is a constant, is initialized to a predetermined value, when a key switch of the internal combustion is activated, or when the internal combustion engine stops.

3 Claims, 5 Drawing Sheets

ELECTRONIC CONTROL TYPE FUEL INJECTION DEVICE

BACKGROUND OF THE INVENTION

1. Field of the Invention

This invention relates to an electronic control type fuel injection device.

2. Discussion of the Background

Referring to FIG. 5, explanation will be given to a general structure of an electronic control type fuel injection device. In FIG. 5, a numeral 1 designates an internal combustion engine, 2, an electromagnetic drive type injector (fuel injection valve) which supplies fuel to the internal combustion engine 1, 3, an air-flow sensor which detects air quantity sucked to the engine, 5, an intake air throttle valve which controls the intake air quantity to the internal combustion engine, provided at a part of the intake air pipe 6, 7, a water temperature sensor which detects a temperature of the engine, and 8, a control device which calculates the fuel quantity to be supplied to the engine from an air quantity signal obtained from the air-flow sensor 3, and applies a pulse width corresponding to a required fuel quantity to the injector 2. A numeral 9 designates an ignition device which generates a pulse signal at every predetermined rotation angle of the engine, 11, a fuel tank, 12, a fuel pump which pressurizes fuel, 13, a fuel pressure regulator which constantly maintains a pressure of the fuel to be supplied to the injector 2, 14, an exhaust gas pipe, and 15, a catalyst through which the exhaust gas passes, and which promotes an oxidation or deoxidation reaction of HC, CO, and NOx, and purifies the exhaust gas. Numerals 80 to 84 designate constituent elements of the control device 8; where 80 is an input interface circuit, and 81, a microprocessor. The microprocessor 81 treats various input signals, calculates a fuel quantity to be supplied to the intake air pipe 6 of the internal combustion engine 1 in accordance with a program which is memorized beforehand in the ROM 82, and controls a drive signal of the injector 2. A numeral 83 designates a RAM which temporarily memorizes data when the microprocessor 81 is performing a calculation. A numeral 84 designates an output interface circuit which drives the injector 2.

Next, explanation will be given of an operation of the conventional device of the above constitution. The control device 8 calculates fuel quantity to be supplied to the internal combustion engine 1, based on the intake air quantity (Q) of the internal combustion engine which is detected by the air-flow sensor 3. The control device 8 obtains a revolution number (N) of the engine rotation pulse frequency number obtained from the ignition device 9. The control device 8 calculates fuel quantity per one rotation of the internal combustion engine 1, and applies a required pulse width to the injector 2, synchronizing with the ignition pulse. The required air-fuel ratio of the engine is necessary to be set to the rich side when the temperature of the engine is low. The pulse width applied to the injector 2, is corrected to increase, in accordance with a temperature signal obtained from the water temperature sensor 7. An acceleration of the engine is detected by the change of the opening degree of the intake air throttle valve 5, by which the air-fuel ratio is corrected to the rich side.

Furthermore, in starting-up of an engine, since a signal of the air-flow sensor 3 is not accurate, the pulse width is to be determined in accordance with a temperature signal of the water temperature sensor 7, with no relation to a signal of the air-flow sensor 3.

Formerly, as shown in FIG. 3, an initial value of Q/N which determines a basic fuel injection pulse width (W), is set to 0. The reason is because, when the rotation number N=0, the corresponding intake air quantity (Q) is naturally set to be 0.

Referring to FIGS. 4A and 4B, compared with a momentary intake air quantity (actual air quantity sucked to a combustion chamber which refers to the broken line of FIG. 4A) in acceleration, an air quantity (Q) measured by the air-flow meter shown by the bold line, is increased, and the air-fuel ratio becomes rich (referring to the downward peak of FIG. 4B). Compared with a momentary air quantity (referring to the alternate long and short dash line of FIG. 4A) in deceleration, the air quantity (Q) measured by the air flow meter, is decreased, and the air-fuel ratio becomes lean (referring to the upward peak of FIG. 4B). As a measure for the over-rich state during acceleration or the over-lean state during deceleration, a dulling treatment is performed on the fuel injection pulse width (W). In the dulling treatment, for instance, the rapid change shown in the bold line in FIG. 4A, is converted to a smoothly changed value shown by the broken line. The conversion equation is, as a general equation, $Y=a\times Y_{(n-1)}+(1-a)\times X_n$, where $a<1$, $X_n$ is an actual variation value, and $Y_{(n-1)}$ is a dulling value in the sampling time of $X_{(n-1)}$ preceding to a sampling time of an actual variation value $X_n$.

In the conventional device, as stated above, the fuel injection pulse width is determined, by setting an initial value of the intake air quantity (Q) when a KEY switch is ON, to 0, by setting an initial value of Q/N which determines a basic fuel injection pulse width (W), to 0, and by applying a dulling treatment.

In the conventional device, the intake air quantity (Q) and the initial value of Q/N which determines the basic fuel injection pulse width (W), are set to 0. The intake air quantity (Q) when the KEY switch is ON, or in case of an engine stoppage, is set to 0. Actually, the pressure in the intake air pipe is at the atmospheric pressure, and the air, quantity in the cylinders of an engine is never exactly 0.

Accordingly, just after the starting-up of an engine, when the fuel is injected in which the fuel injection pulse width (W) is switched to a value determined by the intake air quantity (Q) and the rotation number N, since an initial value of W/N determined by the fuel injection pulse width (W), is set to 0, and a dulling treatment is performed on the fuel injection pulse width (W), which increases the fuel quantity gradually, the value of the fuel injection pulse width (W) is considerably decreased compared with a value which is actually required by the engine. Thus, the injection quantity is decreased, and the air-fuel ratio becomes lean (in short, the air in cylinders of the engine, dilutes fuel, when the KEY switch is ON or in case of the engine stoppage), which causes malfunction such as an engine stoppage, just after the starting-up of the engine.

SUMMARY OF THE INVENTION

It is an object of the present invention to provide an electronic control type fuel injection device capable of preventing an engine stoppage or the like just after starting-up of an engine.

According to an aspect of the present invention, there is provided an electronic control type fuel injection device which comprises: means for determining a fuel quantity corresponding to a running condition of an internal combustion engine by a time length of a fuel injection pulse signal applied to an electromagnetic injection valve of an internal combustion engine; wherein a calculated value of Q/N of a basic fuel injection pulse width W, determined by an equation of $$W=K\times Q/N$$

where N is an engine revolution number, Q is an intake air quantity, and K is a constant, is initialized to a predetermined value, when a key switch of the internal combustion is activated, or when the internal combustion engine stops.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

Figure 1:
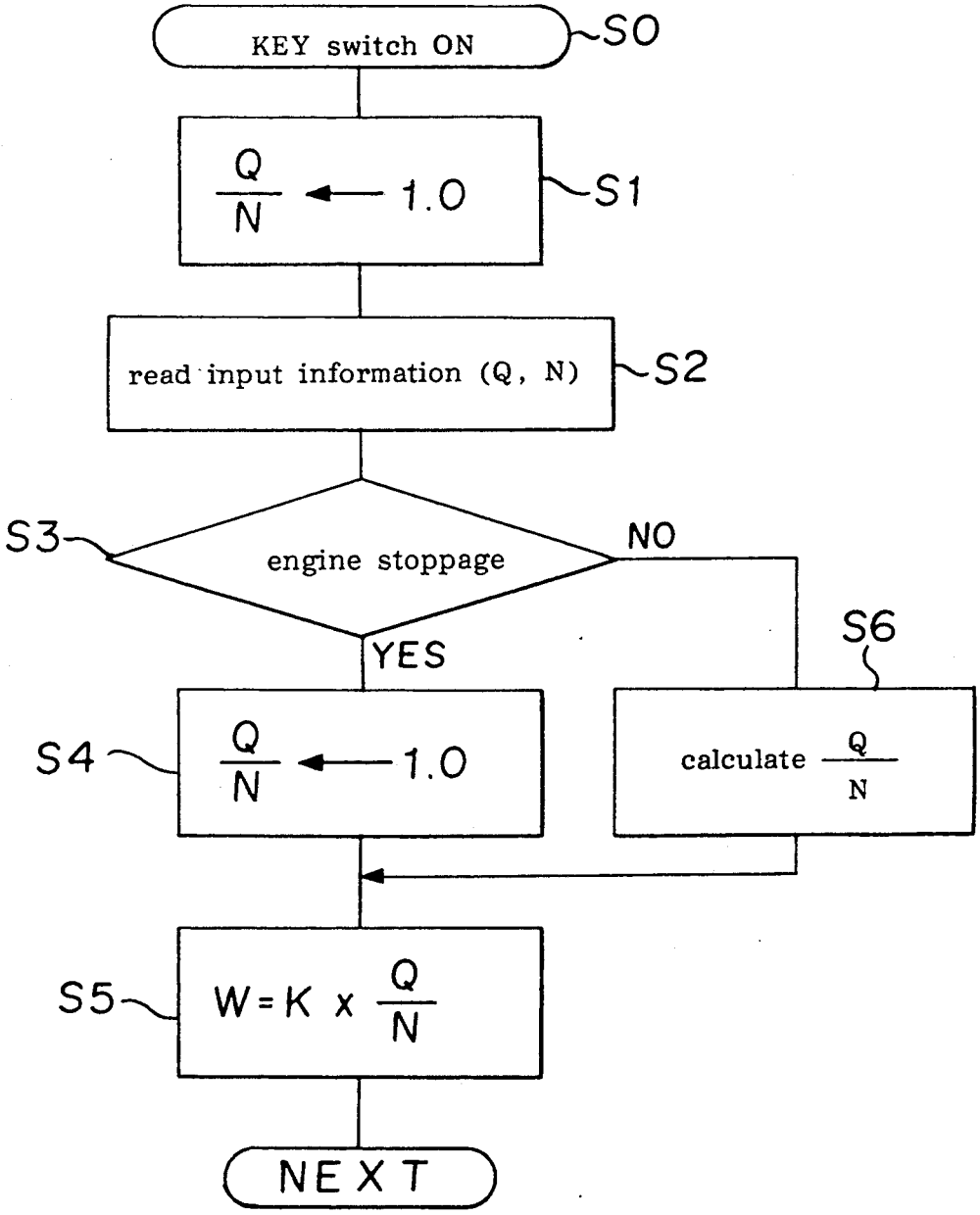
FIG. 1 is a flow chart showing an embodiment of an electronic control type fuel injection device according to the present invention.

Explanation will be given to an embodiment of the present invention referring to FIGS. 1 and 2. FIG. 1 is a flow chart of an embodiment of the present invention, and FIGS. 2A to 2C are graphs showing the behavior of air-fuel ratio and the like in this embodiment. In this invention, a predetermined value of Q/N is set to 1, and the constant K is set, so that when Q/N=1, the basic fuel injection pulse width (W) ($W=K\times Q/N$) becomes a value of an air quantity in which a charging efficiency of a cylinder is 1.0.

In FIG. 1, in step S0, when KEY switch is ON, in step S1, Q/N is initialized to 1. After that in step S2, data regarding Q and N are read. In step S3, judgment is made on whether the engine is in a state of engine stoppage. When the engine is not in the state of engine stoppage, in step S6, Q/N is calculated. When the engine is in the state of engine stoppage, in step S4, Q/N is set to 1. Next, in step S5, the basic fuel injection pulse width (W) is determined.

Figures 2A, 2B, 2C:
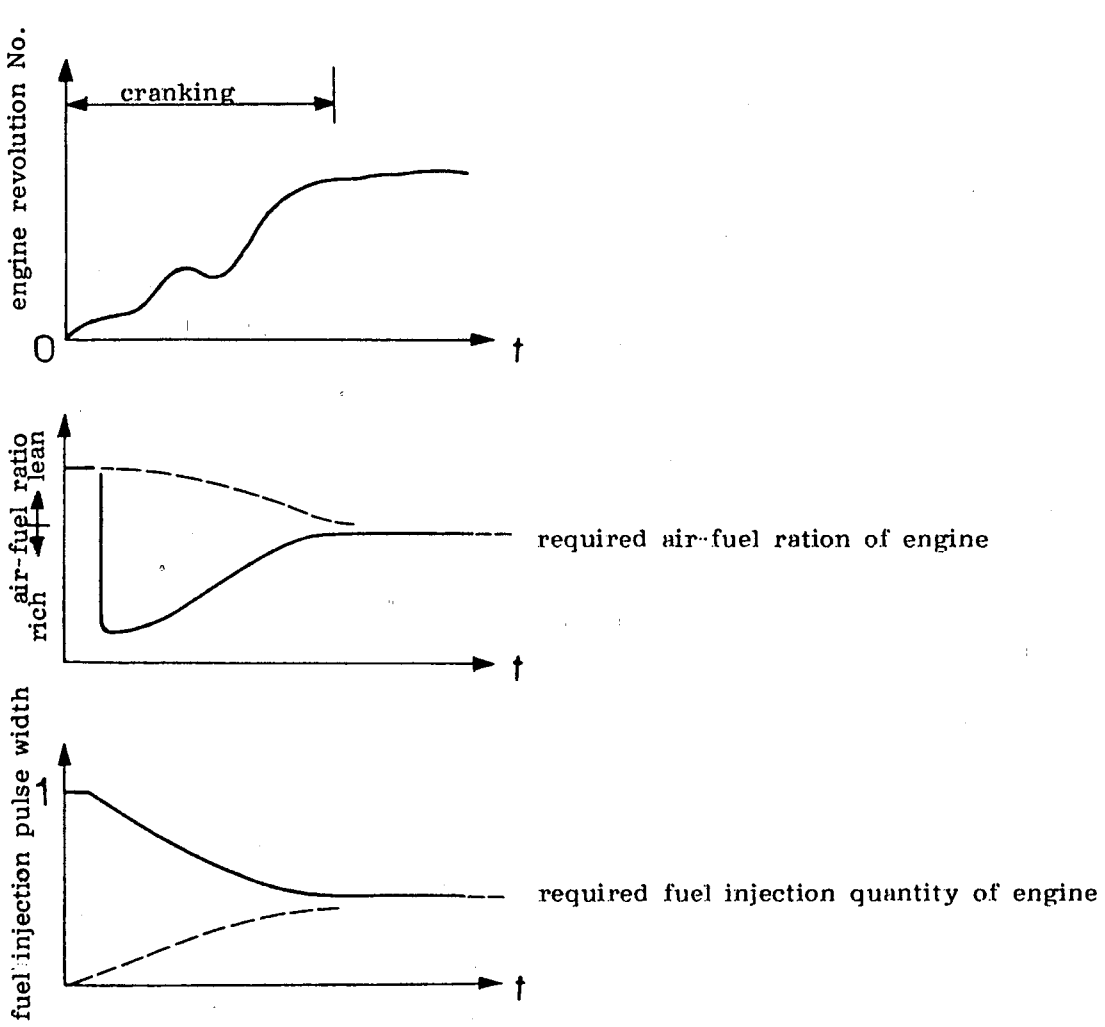
FIGS. 2A to 2C are graphs showing an air-fuel ratio and a fuel injection pulse width during an engine cranking time.
Figure 3:
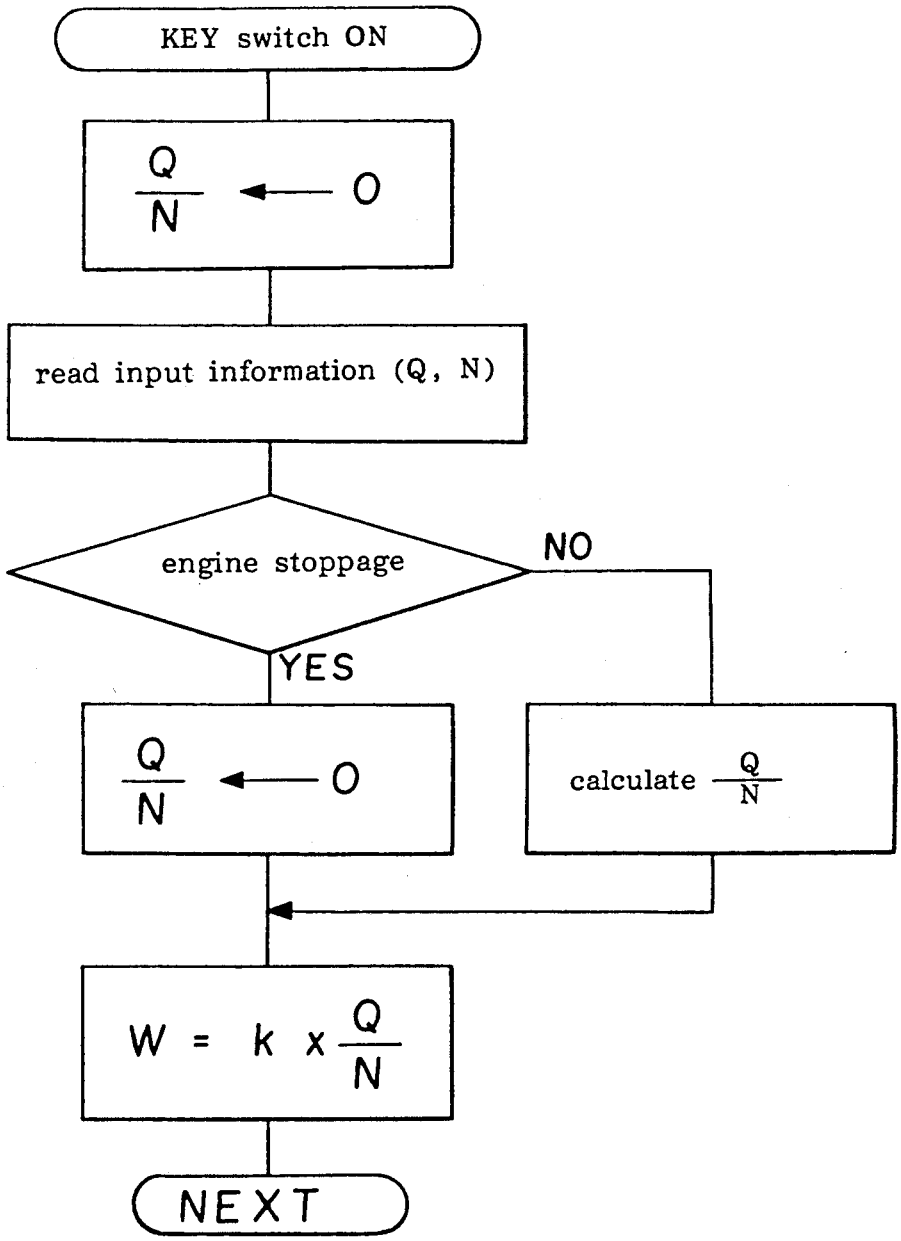
FIG. 3 is a flow chart showing an embodiment of a conventional electronic control type fuel injection device.
Figure 4A:
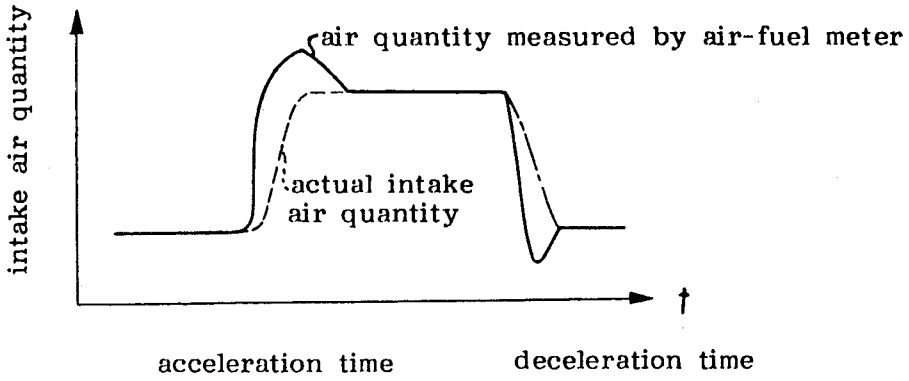
FIGS. 4A and 4B are graphs showing an air-fuel ratio and an intake air quantity during acceleration and deceleration respectively.
Figure 4B:
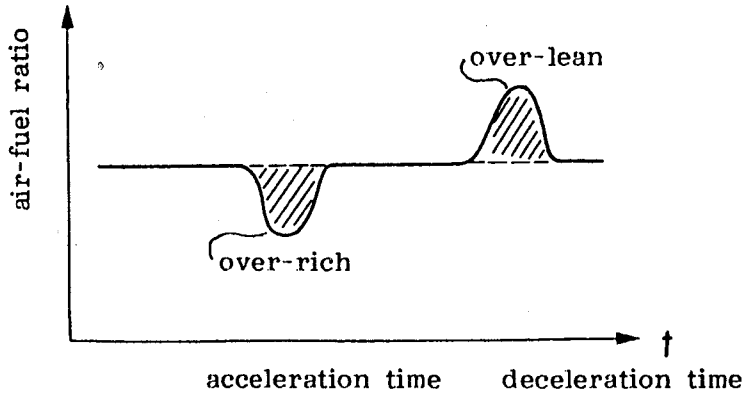
Figure 5:
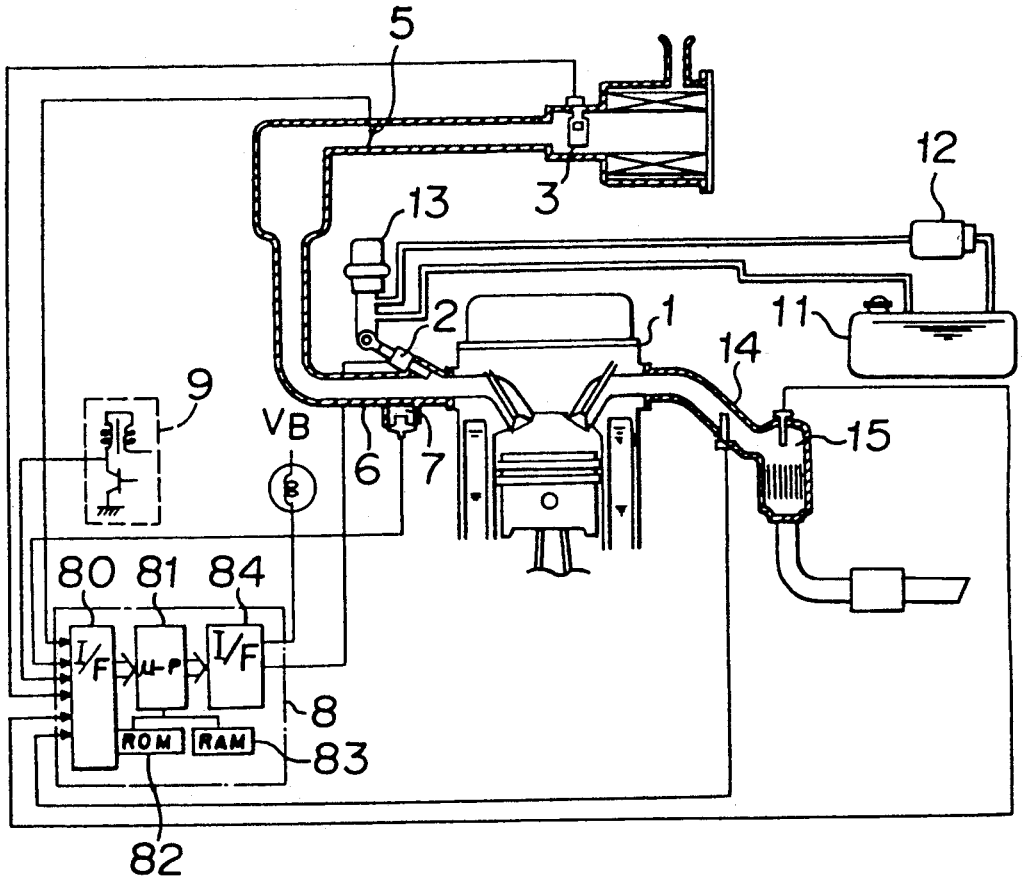
FIG. 5 is a system construction diagram showing a general electronic control type fuel injection device.

In the conventional device, since the basic fuel injection pulse width (W) is increased from the value of 0, and, a dulling treatment is made on the pulse width, a time lag is generated, and the basic fuel injection pulse width cannot reach a value of the fuel injection quantity required by the engine, as shown in the broken line of FIG. 2C. The air-fuel ratio during the engine cranking time shown in FIG. 2A, is actually on the lean side (referring to the broken line of FIG. 2B), which causes a malfunction such as engine stoppage.

However, when the fuel injection pulse width is decreased from a value corresponding to the charging efficiency of 1.0, as shown in the bold line of FIG. 2C, the fuel ratio can reach a value required by the engine, substantially from the rich side, as shown in the bold line of FIG. 2B, which stabilizes the engine revolution number just after the cranking operation.

As stated above, the present invention has an effect in which the promotion of drivability and stability of an internal combustion engine in starting-up of the engine and just after the starting-up operation, are obtained.

What is claimed is:

1. An electronic control-type fuel injection device adapted for use with an internal combustion engine having an electromagnetic injection valve, comprising:

means for determining a fuel quantity corresponding to a running condition of said internal combustion engine, said fuel quantity being based on a duration of a fuel injection pulse signal having been applied to said electromagnetic injection valve of said internal combustion engine;

wherein a calculated value Q/N of a basic fuel injection pulse width W is determined by an equation of:

$$W=K\times Q/N,$$

where N is an engine revolution number, Q is an intake air quantity, and K is a constant, and wherein said basic fuel injection pulse width W is initialized to a predetermined value, when a key switch of the internal combustion engine is activated, or when the internal combustion engine stops.

2. The device according to claim 1, wherein when said internal combustion engine is not stopped, a value of Q/N is calculated and said basic input pulse width (W) is determined.

3. The device according to claim 1, wherein said predetermined value is 1.

* * * * *